US011202925B1

(12) United States Patent
Awad

(10) Patent No.: US 11,202,925 B1
(45) Date of Patent: Dec. 21, 2021

(54) FULL FACE AND HEAD MASK

(71) Applicant: Wadie M. Awad, Columbia, MD (US)

(72) Inventor: Wadie M. Awad, Columbia, MD (US)

( * ) Notice: Subject to any disclaimer, the term of this patent is extended or adjusted under 35 U.S.C. 154(b) by 0 days.

(21) Appl. No.: 17/236,789

(22) Filed: Apr. 21, 2021

(51) Int. Cl.

| | |
|---|---|
| ***A62B 7/10*** | (2006.01) |
| ***A41D 13/11*** | (2006.01) |
| ***A62B 18/08*** | (2006.01) |
| ***A62B 23/02*** | (2006.01) |
| ***A62B 17/04*** | (2006.01) |
| ***A62B 18/00*** | (2006.01) |

(52) U.S. Cl.
CPC ..... *A62B 7/10* (2013.01); *A41D 13/11* (2013.01); *A41D 13/1153* (2013.01); *A41D 13/1169* (2013.01); *A62B 17/04* (2013.01); *A62B 18/006* (2013.01); *A62B 18/08* (2013.01); *A62B 18/084* (2013.01); *A62B 23/02* (2013.01)

(58) Field of Classification Search
CPC ..... A62B 17/006; A62B 18/04; A62B 18/006; A62B 18/00; A62B 18/003; A62B 23/00; A62B 7/00; A62B 7/10; A62B 23/02; A62B 9/04; A62B 18/084; A62B 18/08; A62B 17/04; A41D 13/1184; A41D 13/1161; A41D 13/1169; A41D 13/11; A41D 13/1107; A41D 13/1115; A41D 13/1153; A41D 13/1176; A41D 13/12; A41D 13/1209; A41D 13/1218; A61M 16/0688; A61M 16/0683; A61M 16/0694; B63C 2011/128; A61F 9/027; A61F 9/045
See application file for complete search history.

(56) References Cited

U.S. PATENT DOCUMENTS

| | | | | |
|---|---|---|---|---|
| 2,048,059 | A * | 7/1936 | Giraudet De Boudemange | A62B 7/10 128/201.25 |
| 3,058,463 | A * | 10/1962 | Goodrich, Jr. | A41D 13/1153 128/863 |
| 3,413,972 | A * | 12/1968 | Depping | A62B 18/045 128/201.23 |
| 3,529,594 | A * | 9/1970 | Charnley | A41D 13/0025 128/863 |
| 3,955,570 | A * | 5/1976 | Hutter, III | A41D 13/1153 128/201.23 |

(Continued)

FOREIGN PATENT DOCUMENTS

| | | | | |
|---|---|---|---|---|
| WO | WO-9005565 | A1 * | 5/1990 | A62B 17/04 |

*Primary Examiner* — Tu A Vo
(74) *Attorney, Agent, or Firm* — Wadie M. Awad

(57) ABSTRACT

A multi-purpose protection mask for protecting the human face and head against viruses, bacteria, dust or environmental harsh impacts is presented. It has four elements. A face shield transparent sheet covers comfortably the user's face providing adequate space for freely breathing and wearing glasses. A removable and replaceable filter mask element which is a multi-layer filter piece of a proper material affixed over an opening window in the face shield. A ventilator for draining and filtering the exhalation air and humidity before dumping into the atmosphere and it consists of exhaust fans, suction tubes, suction vents, and exit filters. The ventilator prevents condensation of fogging on the face shield and glasses. Another element is a head cover mask made of a fabric material affixed to the face shield element. Fastener strips means are provided for keeping the face shield comfortable and stable on the wearer's face.

5 Claims, 5 Drawing Sheets

(56) References Cited

U.S. PATENT DOCUMENTS 4,019,508 A * 4/1977 Der Estephanian ..... A41D 13/1209 128/202.19
4,055,173 A * 10/1977 Knab ..... A41D 13/1153 128/847
4,619,254 A * 10/1986 Moretti ..... A62B 17/04 128/201.23
4,741,333 A * 5/1988 Suzuki ..... A41D 13/1209 128/201.23
4,815,458 A * 3/1989 Sing ..... A62B 7/00 128/201.25
4,845,779 A * 7/1989 Wheeler ..... A41D 13/1153 2/84
4,901,370 A * 2/1990 Suda ..... A62B 17/006 128/205.29
4,901,716 A * 2/1990 Stackhouse ..... A41D 13/1153 128/201.25
5,042,474 A * 8/1991 Williamson ..... A62B 23/02 128/206.12
5,099,525 A * 3/1992 Millauro ..... A41D 13/1115 128/206.19
5,253,642 A * 10/1993 Stackhouse ..... A41D 13/11 128/201.25
5,452,712 A * 9/1995 Richardson ..... A62B 17/04 128/201.22
6,014,971 A * 1/2000 Danisch ..... A62B 18/045 128/201.25
6,134,716 A * 10/2000 Richardson ..... A41D 13/11 2/171.2
6,526,585 B1 * 3/2003 Hill ..... A41D 13/1161 128/206.14
10,137,320 B2 * 11/2018 Walker ..... A62B 18/006
10,449,397 B2 * 10/2019 VanDerWoude ..... A62B 7/00
10,960,238 B1 * 3/2021 Reele ..... A62B 18/084
11,065,479 B1 * 7/2021 Rafalovich ..... A62B 7/10
2001/0037519 A1 * 11/2001 Paris ..... A41D 13/11 2/422
2003/0136411 A1 * 7/2003 Hsieh ..... A62B 17/04 128/206.25
2009/0144884 A1 * 6/2009 Duncan ..... A62B 17/04 2/410
2011/0093998 A1 * 4/2011 Brennan ..... A41D 13/001 2/4
2014/0238392 A1 * 8/2014 Johnston ..... A62B 17/04 128/201.25
2015/0113711 A1 * 4/2015 Kim ..... A42B 1/046 2/424
2016/0193485 A1 * 7/2016 Izz ..... A62B 18/04 128/201.25
2016/0199674 A1 * 7/2016 Johnson ..... A62B 18/02 600/549
2016/0271428 A1 * 9/2016 Ehler ..... A62B 9/006
2016/0316831 A1 * 11/2016 Yarahmadi ..... A41D 23/00
2018/0177251 A1 * 6/2018 Yoo ..... A61B 90/35
2020/0268995 A1 * 8/2020 Shin ..... A61M 16/06
2020/0297044 A1 * 9/2020 Xie ..... A41D 1/002
2021/0001158 A1 * 1/2021 Ishikawa ..... A41D 13/1153
2021/0093903 A1 * 4/2021 Edwards ..... A62B 18/025
2021/0128953 A1 * 5/2021 McCoy ..... A62B 18/04

* cited by examiner

FULL FACE AND HEAD MASK

REFERENCES CITED

U.S. Patent Documents

| | | |
|---|---|---|
| 798,877 | September 1905 | Conne |
| 4,323,063 | April 1982 | Fisichella |
| 4,593,417 | June 1986 | Brown, Jr. et al. |
| 4,856,509 | August 1989 | Lemelson |
| 5,704,063 | January 1998 | Tilden |
| 6,698,427 | March 2004 | Clowers |
| 7,240,372 | July 2007 | Larson |
| 7,992,558 | August 2011 | Thornton |
| 8,387,163 | March 2013 | Beliveau |
| 8,528,561 | September 2013 | Ng, et al. |
| 9,119,931 | September 2015 | D'Souza, et al. |
| 9,949,667 | April 2018 | Alshaer, etal. |
| 9,962,511 | May 2018 | Ng, et al. |
| 1,0004,866 | June 2018 | Davis |
| D844,284 | April 2019 | Travis, et al. |
| 1,0231,495 | March 2019 | Nabai |
| 1,0463,091 | November 2019 | Bourque |

DESCRIPTION

Field of the Invention

The field of the invention relates generally to face and head covering masks and protective outwear to be used for protecting the face and head from infections, spreading viruses, germs, bacteria, dust and other harmful environmental elements.

Background of the Invention

Face masks are worn for a variety of purposes including protection against spreading viruses, germs, bacteria, dust and other harmful environment elements. In 2019, the world started suffering from the Covid-19 pandemic which attacked many people through their respiratory system. Most countries around the world issued obligatory instructions to wear masks in closed places and in social contacts. Even with more people getting vaccinated against the virus, masks are still required and recommended to limit the spread of the virus and protect against new strains. Several researches shows that it is possible that a vaccinated person may still be an asymptomatic carrier to the virus in their nasal passageway and transfer it by speaking, breathing, sneezing, etc. A proper effective mask will protect from being infected and will also control the spread of the virus. Accordingly, masks became a daily essential tool to protect ourselves and others from the Covid-19 pandemic.

Masks are also used to protect users against environmental harsh elements such as harmful sun rays, sunburn, wind burns, and to also guard against rainwater. Specific masks and face guards are also very common in some industries and professions, such as masks used by medical staff to protect against infections and industrial masks protecting labors in certain industries.

Most known face-covering masks cover just the nose and mouth using a single piece of material attached to the user's head via fastener strings hanging over the user's ears. Known masks are often designed in a manner such that the user must breathe directly through the material of the mask, or through small designed openings. Such masks may not protect the user from viruses since it is not completely tight on the user's nose.

Present mask designs have a number of drawbacks. Masks envelop the entire nose or cover nearly the entire nose and mouth. The nasal breathing exhaust becomes trapped under the mask where it naturally travels up between the mask and the face to the eye opening, where it is expelled, oftentimes fogging up a wearer's glasses or goggles which may be worn by the user and may thus temporally at least blind the user to any dangers in his or her immediate surroundings. So, as many people wear face-covers or masks in combination with glasses or goggles, require that their eyewear functions properly and it is desirable to get as much of the nasal exhaust away from the mask.

In addition, no matter what the type of mask covering is, water vapor, and in some cases viruses which might exist in user's exhaled breath tend to condense on the mask material around the user's nose and mouth from which it is expelled. This water-vapor, which either freezes or remains wet, is uncomfortable and can irritate the user's face. For ventilation, some face masks include a series of small holes in the face-covering material which are not properly tight on the user's face.

Many masks are impractical as it limits user's access to his or her mouth to eat, drink, communicate, etc. Existing face masks are made from an array of material including neoprene, fleece, nylon, cloth and others.

Due to these concerns, a number of designs incorporating face protection means, such as a mask, face shields and a hat have been suggested. Examples are not limited to what will be mentioned herein after. U.S. Pat. No. 798,877 by Conne discloses a hat with a visor. The visor is hinged to the body portion of the hat and can be swung down into position to be used as a face protector. In addition, the visor can be removed from the hat. U.S. Pat. No. 4,593,417 by Brown, Jr. et al. describes a mask and a hat combination, where the mask portions can be folded out of the way. The folded mask portions can be folded upward and affixed to the crown of the hat. U.S. Pat. No. 4,856,509 by Lemelson, is relating to improvements in face masks, particularly for use in preventing the spread of disease such as colds, influenza and the like wherein a select portion or portions of such mask contain a disease or viral destroying chemical or biological agent. It covers the nasal and mouth portions of the face of a wearer.

U.S. Pat. No. 5,704,063 by Tilden, presents a face protector with a covering body for covering a user's face below the eyes, and attachments for attaching the covering body to the user's head. The face protector includes a "breathing vent skirt" for covering the user's nose. One drawback to this design is that the breathing vent skirt leaves the nostrils exposed and does not properly protect the tip of the nose. The skirt extends down too far and traps a great deal of nose and mouth exhaust. In this construction, warm air is forced to travel up between the mask and the user's face until it is exhausted along the upper edge of the mask beneath the eyes where it can condense on glasses lenses. U.S. Pat. No. 7,240,372 by Larson, is a multi-purpose hat. The hat includes a traditional hat portion and a removable mask portion adapted to comfortably conform to users' head and face. However, this face mask that can be attached to a hat may be difficult to attach and reattach. In addition, the face mask may allow for cold air, dust, viruses and other unwanted particles to enter the facial area, due to the mask not being fitted to the wearer's face or adjustable to the wearer's face. Also, still the eyes are exposed to infection and pollution. U.S. Pat. No. 10,231,495 by Nabai, is a medical mask with loupe light-compatible eye shield. It is a face mask with a filter mask portion. It still has unsealed open vents which can allow viruses to get in and infect the user through his face and nose. U.S. Pat. No. 10,463,091 by Bourque is a multi-piece face covers for protecting the human face, head, neck and/or shoulders against environmental conditions. Its assembly is including at least two or more separate, attachable and independently movable pieces. It includes 2-4 separate pieces which can be worn together or individually. This assembly does not provide adequate ventilation which may cause condensation of vapor on the wearer's glasses and the face cover pieces and also does not provide protection against viruses or germs and bacteria. U.S. Pat. No. D844,284 by Travis, et al., combined face mask and scarf. Some two-piece masks suggest a bottom section that is like a bandanna or scarf. These designs are undesirable because they do not properly insulate the face well enough to protect user's face against viruses, dust and germs. The lower piece of such masks are typically attached to the user's head by a lone strap which extends around the neck. However, such strapping means are ineffective to keep the lower piece in place. In addition, the bottom piece of these two-part systems are spaced from the upper piece and, thus, do not completely cover the user's face.

Most of the already known masks which cover the nose and mouth should be adequately tight on the nose and mouth areas. They are fastened behind the head by straps, hanging over the wearer's ears. Unfortunately, such straps are harmful, painful and uncomfortable. It also creates unnecessary and in some cases painful pressure on the nose as well as not leaving enough space for air circulation and comfortable respiration. Also, such strapping loses tension overtime causing the mask to slip down and, thus, no longer provide protection to the user.

While these embodiments fulfill their respective, particular objectives and requirements, they do not describe a multi-purpose personal mask for protecting user's face and head from viruses, bacteria, germs, dust and environmental harsh elements as well as meeting all the above needs. Prior devices either inadequately cover the above-mentioned exposed areas or cover only a portion of the wearer's face, head or neck. They do not provide adequate ventilation, sufficient protection to the user or comfortable and safe breathing. They are also inconvenient to use and do not provide proper draining to the exhaled humid air.

Hence, there is a need for a mask that can easily cover and protect the user's face and head while maintaining effective ventilation, comfortable handling and ease of wear. Accordingly, it would be advantageous to have a mask that covers the user's face and head, and has a breathing structure which facilitates venting and filtering of exhaled air and hence reducing the spread of viruses, bacteria, germs and infections. By providing that adequate ventilation, we prevent the condensation of moisture and exhaled air on the mask that may cause fogging on user's protective eyewear. It would also be advantageous to have a face and head mask that protects eyes from exposure to harmful viruses, germs, bacteria and dust.

SUMMARY OF THE INVENTION

The present invention in accordance with a general aspect is a face and head protector comprising a covering body that covers the full user's head including face, mouth, nose, eyes, and neck. The present disclosed embodiment addresses and ameliorates one or more of the above-mentioned deficiencies in the prior art.

The present disclosure, full face and head mask, assembly includes four main assembled elements: a face shield element, a filter mask element, a ventilation system element, and a head cover mask element.

The face shield element is a flexible clear vision sheet made of an elastic material to be easily folded over the user's face. It covers the face portion from the top of the forehead to the bottom of the user's chin. It also covers at least a portion of the user's cheeks and substantially covers all of the user's eyes, nose and mouth. Within the face shield body there is a rectangular opening named filter mask window. The edges of the opening are covered by a soft gasket for protecting the user's skin from scratching, itching or hurting. This opening is covered by the filter mask element. The size of the opening gives the opportunity to the wearer to access his/her mouth for drinking or eating without having to take off of the whole embodiment. The design of the disclosure also, allow the user's mouth to open and close normally without affecting the fit or positioning of the face shield on the user's face. On the four corners of the filter mask window, there are four pin support beds used for attaching the filter mask element. At the top of the face shield element, there is a sponge pillow attached on the face shield element from inside to keep a distance between the face shield sheet and the eyes of the wearer and allow for a space to have the glasses rest comfortably on the wearer's nose. In addition, the face shield element practically gives a reasonable space between the face skin and the face shield body which provides a more comfortable space for breathing. In order to keep the face shield element folded around the face, a system of fasteners is designed and attached to it to be adjustable and comfortable for the wearer.

In accordance with the embodiment, the filter mask element is desired fulfill the requirement and purpose for the wearer's use. It is a removable and replaceable piece of selected material for commercial masks. The material of the filter mask element, specifications, quality and efficiency are defined by the user's needs and purpose. For medical purposes, the material of the filter mask element should be efficient to protect the user from penetration of viruses, germs, or bacteria that may cause infection to the wearer. However, for public usage, it could be just for protection from spreading viruses or germs, bacteria, dust and environmental harsh elements. Some of the commercial masks are made of cloth layers and others are more sophisticated made from specified materials to resist penetration or spreading out of viruses, germs or bacteria. Other types of masks are made of chemical materials that are capable of killing viruses or bacteria before they reach the wearer's respiratory system as well as protecting others if the wearer is the one infected with virus, germ or bacteria.

The filter mask element attaches tightly and sealed on the face shield window opening by a mean of an adhesive sticky material on its boundaries. It is important to note that the filter mask element is replaceable and also removable from its fixation on the face shield element if the wearer would like to access his/her mouth or nose.

Regardless of the material and the type of the filter mask element used, it is fixed via two rigid fixation sticks on both ends. Each fixation stick ends by two small pins which rest in the grooves of the pin support beds attached on the face shield element body. At the middle of each stick, there is a bent handle ring for easy and safe removal or fixation of the filter mask element on the face shield window without having to touch the body of the filter mask. The dimensions of the filter mask element are reasonable to fit and cover the face shield window opening on the face shield element.

According to another aspect of the present disclosure, it is provided by a ventilation system. Its function is to exhaust the accumulated vapor, humidity and exhalation out of the space under both the face shield and the filter mask elements to the atmosphere. It prevents fogging and condensation of vapor on the wearer's glasses even on the face shield element. The ventilation system provides aeration and refreshment to the wearer's face. It also exhausts the air around the nostrils to prevent condensation from breathing around the nose where it can cause uncomfortable wetness and humidity. The construction of the ventilation system is composed from: one or more exhaust fan secured inside a box, ventilation tubes, ventilation vents and a source of power. The exit of the exhaust fan box is covered by means of an exhaust fan outlet filter sheet made of a fabric layer for preventing seeping of the air from outside to inside the disclosure, and filters exhaust air before getting out to the atmosphere. There is a source of power which generally could be regular batteries or others. The combination of the exhaust fan and the batteries are assembled inside a box named exhaust fan box attached inside a one pocket or more on the outer side of the head cover mask element. It may be attached at below the chin level or at the top head of the head cover mask element. The ventilation vents are located at the top and bottom ends of the face shield element. The exhaust fans are designed with sufficient suction volume enough to exhaust the exhalation and vapor volume per minute from the space between the face shield element and the wearer's face skin.

Another element of the present disclosure is the head cover mask element. It is a closed cylindrical tube-shaped fabric garment with an opening at the bottom to the user to wear it. It's fitting size can be large, medium or small so it can fit adults, juniors and toddlers. It is of course understood that any other suitable or desired material or combination of materials may be used for the construction of the head cover element of the present disclosure. The material could be impervious or semi-impervious. However, it should be from a material provides protection against penetration of viruses, germs, bacteria or dust. The head cover mask is fixed tightly on the surrounding edges of the face shield body by a means of a glue. The head cover mask element material is audio port. On the body of the head cover mask element there are one or more pocket for holding the exhaust fan box or boxes. The head cover mask element is kept tight around the neck by a mean of a fasten neck band cord. The head cover mask element is designed to accommodate man or woman orientation and also wearer's glasses requirements or non-wearers of glasses.

The present disclosure, full face and head mask, avoids the miss-wearing of other masks which in many evidences loose, slip and not tight protect. The present invention is provided by three different means of fastener straps to keep it stable and steady on the user's face and head. It includes a respective straps of stretchy fabrics that extend over and around the crown of the user's head and neck to ensure proper positioning and placement of the embodiment on the user's face and provide proper insulation. In addition, this combination of fasteners are comfortable and not hurting ears of the wearer.

In accordance to the present disclosure, it is designed for ease of packing, marketing and carrying in the unused mode and be kept in a flat position.

One of the features of the present embodiment, it totally covers the face, head and neck and effectively protects the wearer from airy-infection by viruses provided that it is equipped with a medical efficient filter mask element.

Another object of the invention is to provide an environmental shield that adequately protects the exposed areas of the body and is well ventilated, comfortable to wear and not bulky.

Other objects, features, and advantages of the present invention will become apparent from the following detailed description. It should be understood, however, that various changes and modifications within the spirit and scope of the invention will become apparent to those skilled in the art from this detailed description.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiment and modes for carrying out the present invention when taken in connection with the accompanying drawings and the appended claims.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

Figure 1:
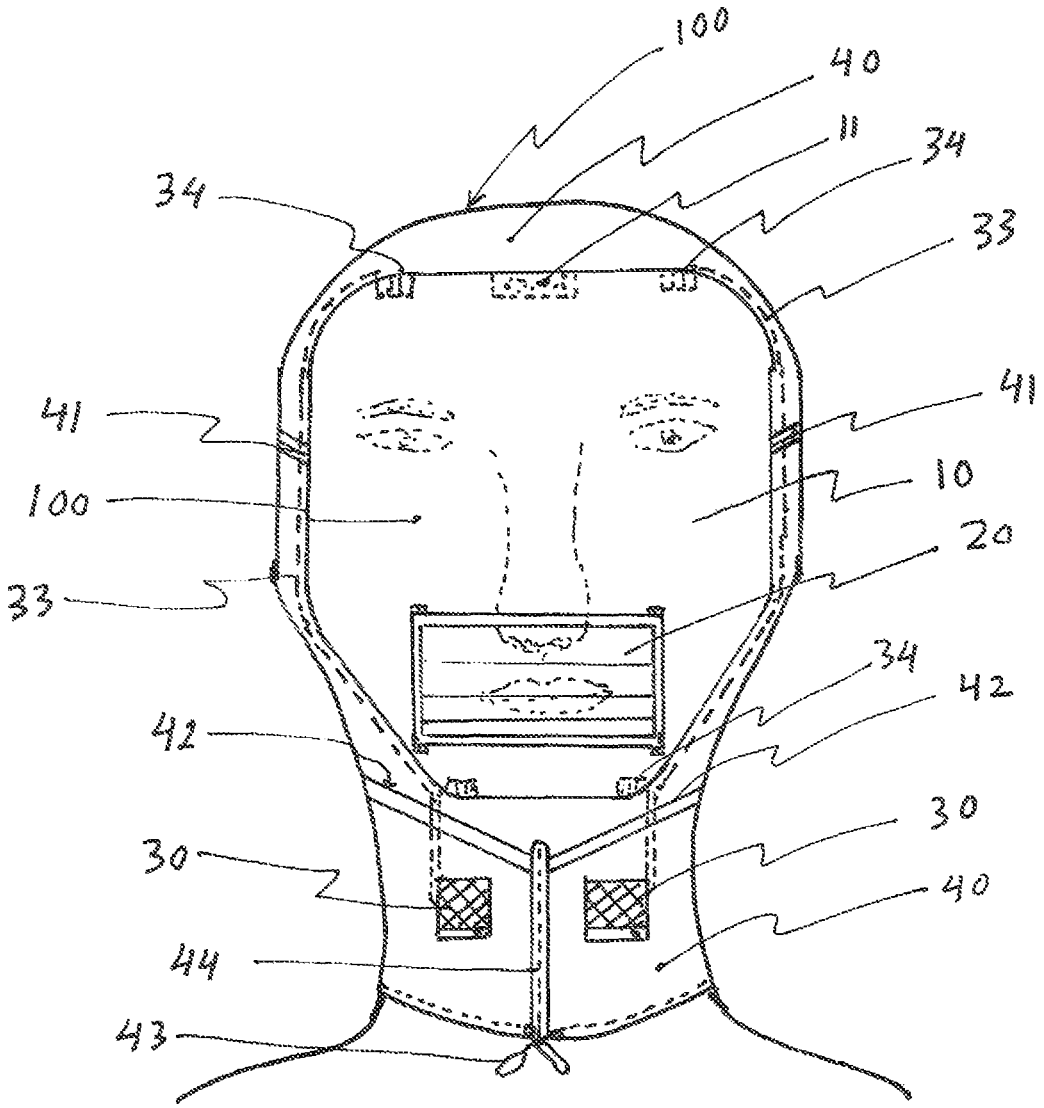
FIG. 1 is a front perspective general view illustration of a full face and head mask assembly in the position of putting on by user in accordance with aspects of the present disclosure.

Referring to the drawings, wherein like reference numerals refer to like features throughout the several views. The drawings presented herein are not necessarily to scale and are provided purely for explanatory purposes. Thus, the specific and relative dimensions shown in the drawings are not to be considered limiting unless explicitly stated otherwise in the claims.

As shown in FIG. 1 is a representative general view of the "full face and head mask"100 assembly, designated generally to the main elements of the embodiment: a face shield element 10, a filter mask element 20, a ventilation system element 30, and a head cover mask element 40 in accordance with aspects of the present disclosure.

FIG. 1, also shows two subsidiarity components of the ventilation system element 30: the suction tubes 33 and the suction vents 34 on both sides of the face shield element 10 and they are shown with hidden lines because they are covered by the face shield 10 and the head cover mask 40 at the contact edge of both elements. Also, it shows the head cover mask 40 which covers the head and the neck of the wearer as an element of the present embodiment. More details and description of each element of this embodiment and its related components will be discussed in more elaboration during the discussions of the coming figures.

Figure 2:
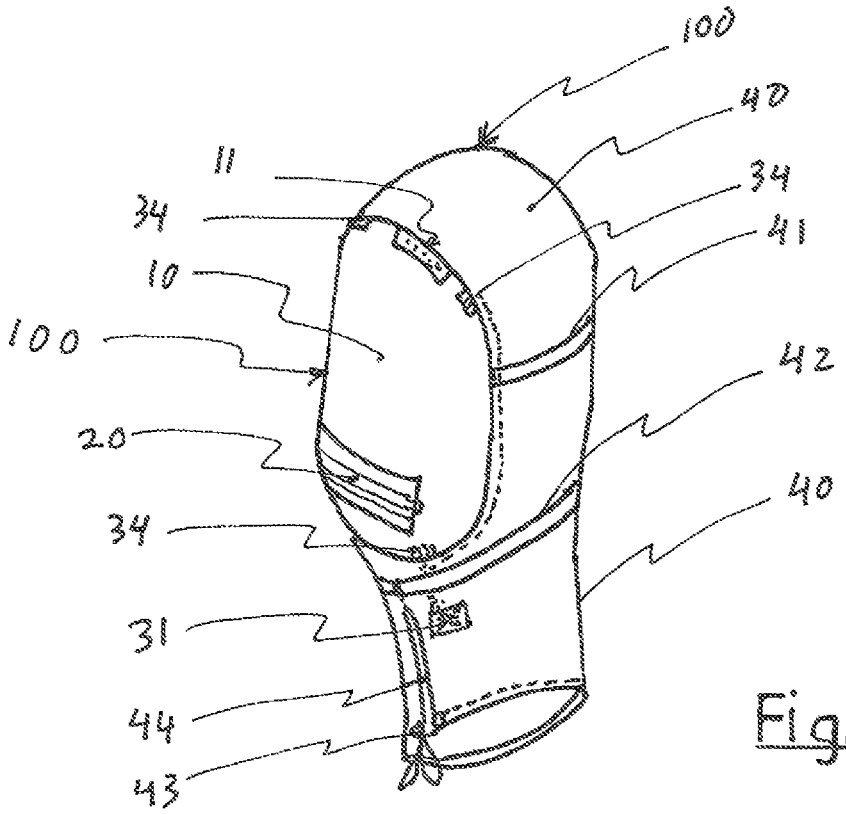
FIG. 2 is a schematic view illustration of the full face and head mask of the present disclosure as it is in a wearing position on a user's head.
Figure 3:
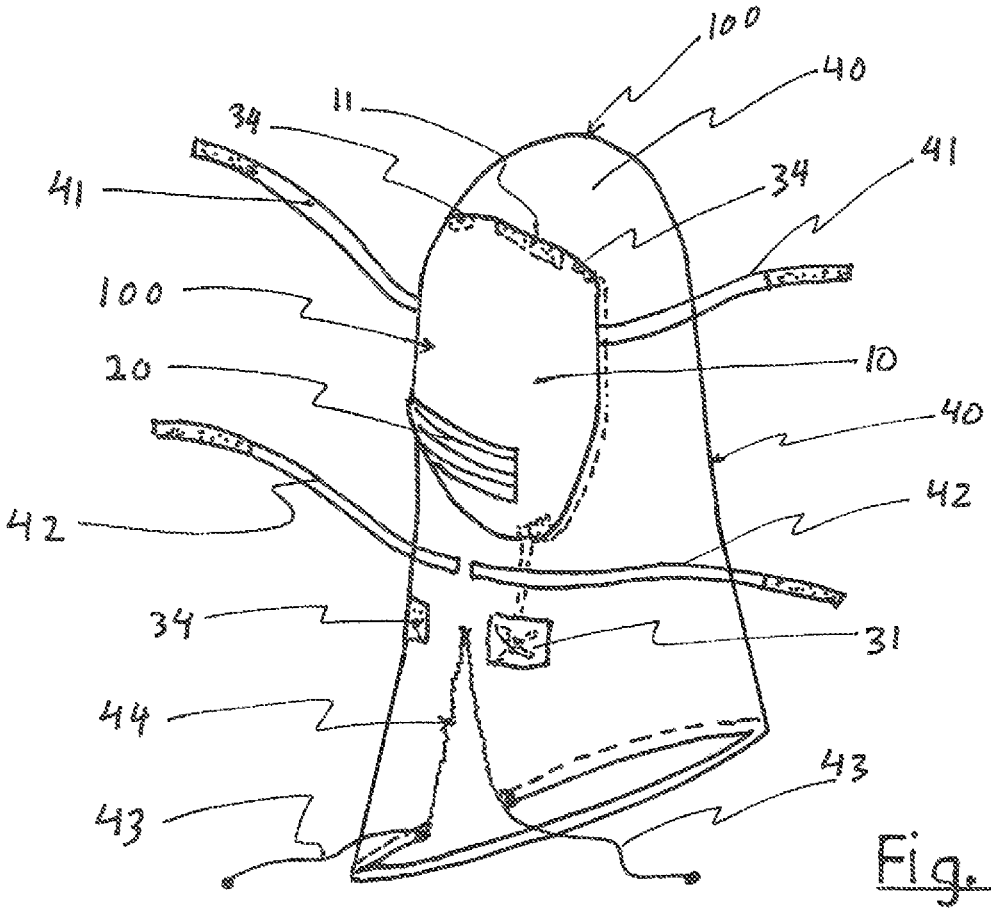
FIG. 3 is a schematic view illustration of the present disclosure as it is in a put off position on a user's head.

FIGS. 2 and 3 are two isometric-views illustration of the embodiment. One is showing the embodiment in the position of putting-on and the other is showing the embodiment in the putting-off position by the user. Both figures show how the embodiment covers the user's head, nose, mouth and cheek areas of the face and the neck. It also shows the fastener bands: the head band 41 which is composed of two pieces strap extends encircle around the head almost at the level of ears. The two pieces are sticky by a means of any type of sticky materials such as VOLCRO™ which is a well known commercial material. It is flexible and adjustable to the proper size of the user's head. The wearer can adjust the head band 41 according to the circumference of the head and to keep the face shield element 10 folded around the face in a comfortable position without stress on the nose. The middle band 42, it is the same like the head band 41. It adjusts tightness of the head cover mask 40 just below the level of the user's jaw. In order to keep the head cover mask 40 tight and not to allow air flow from the atmosphere inside the embodiment a fasten neck band cord string 43 encircles around the neck. The face shield 10 is kept in a distance apart of the forehead of the user by a soft pillow 11.

FIG. 3 is another schematic-view of the present embodiment in the position of putting off. It shows the components of the embodiment which are provided to give more flexibility to the users during putting on or putting off. It shows also the position of a zipper 44 in the head cover mask 40 element and the fasten band cord string 43.

Figure 4:
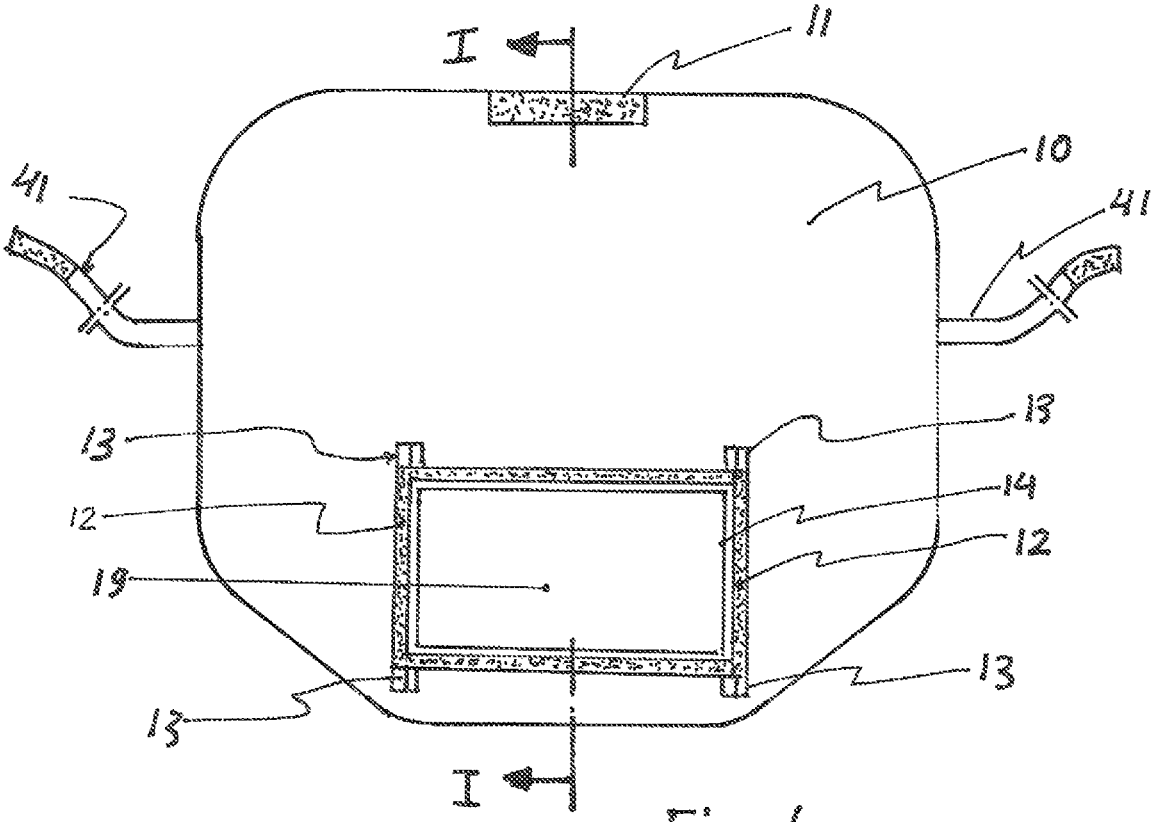
FIGS. 4, 5 and 6 are a front-view of the face shield element, a cross section view in the face shield element and an isometric-view for one of the pin beds of the filter mask of the present disclosure.

FIG. 4 is a front-view of the face shield element 10 of the present disclosure. It provides more details. The face shield 10 is a flexible visual sheet made of a clear elastic material such as PVC. The dimensions are relatively change according to the size whatever is it: large, medium or small. At the top, there is a soft pillow 11 made of soft sponge material. This soft pillow 11 has multiple functions. It keeps an appropriate distance between the face shield body 10 and the wearer's face skin. This distance could be comfortable for the users who used to wear glasses. It also keeps the face shield element 10 almost up-right. According to this structure of the face shield 10, it provides a comfortable space for the wearer for breathing and does not put stress on the nose. FIG. 4 also shows the connection of the head band strap 41 position.

Within the face shield 10 element body, there is a rectangular opening, named as filter mask window 19. Its dimensions are adequate to cover the area of the nostrils, the mouth and almost till the user's chin lower end. The opening dimensions are to cover the area from above the nostrils and extends down below the lower lip of the user's mouth. The opening width is almost slightly larger than the mouth opening.

The internal sharp edge of the filter mask window 19 is covered by a soft gasket ring 14 which made of any soft material to protect the facial skin of the user from scratching or hurting. The outer circumference of the filter mask window 19 is covered by a sticky adhesive window strip 12. This sticky material is for holding tightly the filter mask element 20 on the edges of the filter mask window 19. This material is durable for allowing replacing and removing the filter masks element 20 several times. It is also to keep the filter mask 20 tight on the face shield 10 body without allowing air seeps inside through edges of the filter mask window 19. At the four edge corners of the filter mask window 19, there are four pin support beds 13.

Figure 5:
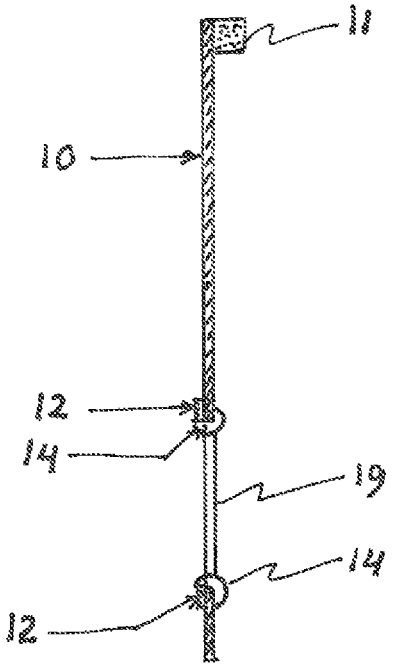

FIG. 5 is a vertical cross section view through the face shield element 10 body showing the components and accessories on the face shield 10. It shows the soft pillow 11, the sticky adhesive window strip 12, and the soft gasket ring 14 on the circumference of the filter mask window 19.

It may be desirable that the material of the face shield 10 reflects a minimal amount of light into the user's eyes, while absorbing as little heat as possible. This face shield element 10 could be made of medical-grade materials for use in protecting the faces of post-operative patients and those who are particularly concerned with sun-exposure.

Figure 6:
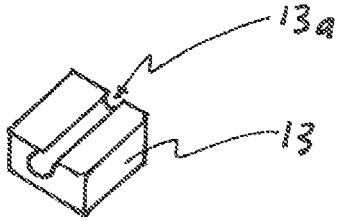

FIG. 6 is an isometric-view for illustration of one of those pin support beds 13 which their function is for supporting the filter mask element 20 on the face shield element 10. The pin support bed 13 is a plastic cube block provided by a groove 13*a* at the middle of the top surface for resting the fixation pin 21*a* of the filter mask element 20 on it.

Figure 7:
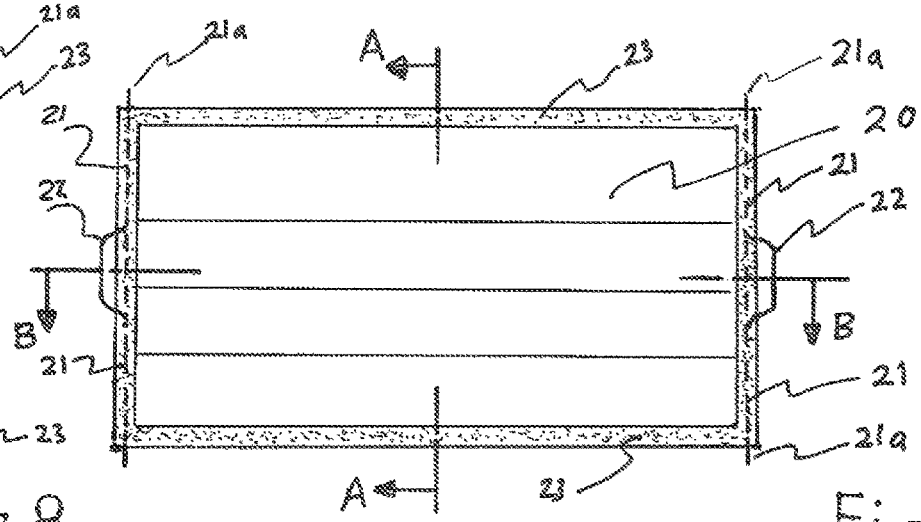

FIG. 7 is a front-view illustration for the filter mask element 20, which it is a multi-layer filter mask. It could be made of different materials and grades or it could be a medical layer mask, or cloth mask, or chemical mask for protection from gasses or preventing viruses and bacteria. For some purposes of using this embodiment, such as for preventing viruses, germs, bacteria or gases and others, the filter mask 20 element, may be exposed to antiviral chemicals for killing viruses and bacteria or germs before entering through and reaching the wearer nostrils. The purpose of using this embodiment could be also for protecting user against dust, particles, and droplets. However, the material of the filter mask element 20, specifications, quality and efficiency are defined by the user's needs and purpose. If it is for medical purposes, the material of the filter mask element element 20 should be efficient to protect the user from penetration and causing infection of viruses, germs, or bacteria. For the general public uses, it could be just for protection from spreading viruses or germs and bacteria. Some of the commercial masks which their materials could be used for the filter mask element 20 manufacturing are made from cloth layers and others are more sophisticated manufactured from specified materials to resist entering or spreading viruses or germs or bacteria. Some types of these masks are provided by chemical materials for killing viruses or bacteria before reaching the respiratory system of the wearer or on the other side spreading them out if the wearer is a carrier for viruses or germs or bacteria.

The filter mask element 20 is affixed all around boundaries on the face shield window opening 19 by an adhesive mask strip 23, to keep it sealing and tightness over the face shield window opening 19. The adhesive mask strip 23 rests on the adhesive window strip 12. Whatever the material of the filter mask element 20, the two vertical ends of the filter mask 20 each has been provided by a fixation stick 21. The fixation stick 21 is made of plastic and ends by two fixation pins 21*a*, one at the top and one at the lower end. Each pin 21*a* rests on one of the grooves 13*a* of the pin support beds 13. At the middle of each of the fixation stick 21, there is a bend forming a handle ring 22. This construction of the fixation stick 21 and the handle ring 22 is to facilitate to the user safely and without pollution attaching or removing of the filter mask element 20 on or off from the filter mask window 19. By this facility, the user can attach the filter mask 20 over the filter mask window 19 easily without touching the filter mask body 20 and causing pollution or contamination.

Figure 8:
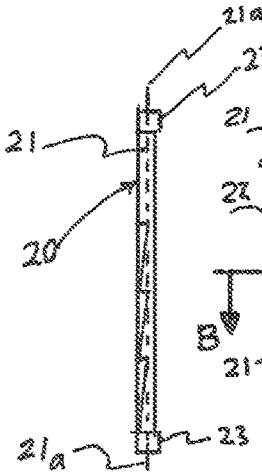
FIGS. 7, 8 and 9 are a front-view for the filter mask element and two cross section views through the filter mask element of the present disclosure.
Figure 9:
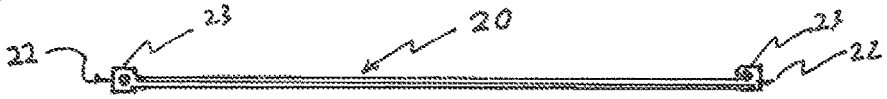

FIGS. 8 and 9 are both vertical and horizontal cross section views through the filter mask element 20 of the present disclosure. They illustrate more details of the components of the filter mask element 20.

The filter mask element 20 is a replaceable piece and it is not restricted by any kind or material. Having replaceable of this component affords this present disclosure, the full face and head mask 100, has a longer use life. The filter mask element 20 is also removable from its fixation on the face shield 10 giving to the wearer flexibility if he or she would like to access his/her mouth or nose. The dimensions of the filter mask element 20 are reasonable to fit and cover the filter mask window 19 of the face shield element 10.

Turning now to FIGS. 10, 11, 12, 13, and 14. These figures are illustrations for the ventilation system element 30 and its components. Reference is FIG. 10 which is a schematic for the ventilation system element 30. It shows the components of the system starting by an exhaust fan 31 appears in dotted lines because it is hidden inside the exhaust fan box 31*a*. More details and elaboration of the exhaust fan box 31*a* will be discussed with FIGS. 12, 13, and 14.

Figure 11:
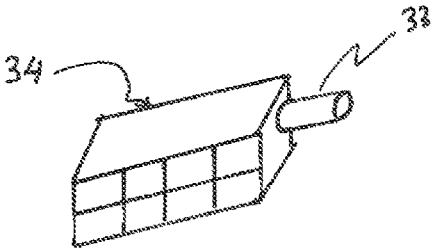
FIGS. 10 and 11 are schematic view illustration of the ventilation system element and an isometric-view for the suction vent component of the ventilation system element.
Figure 10:
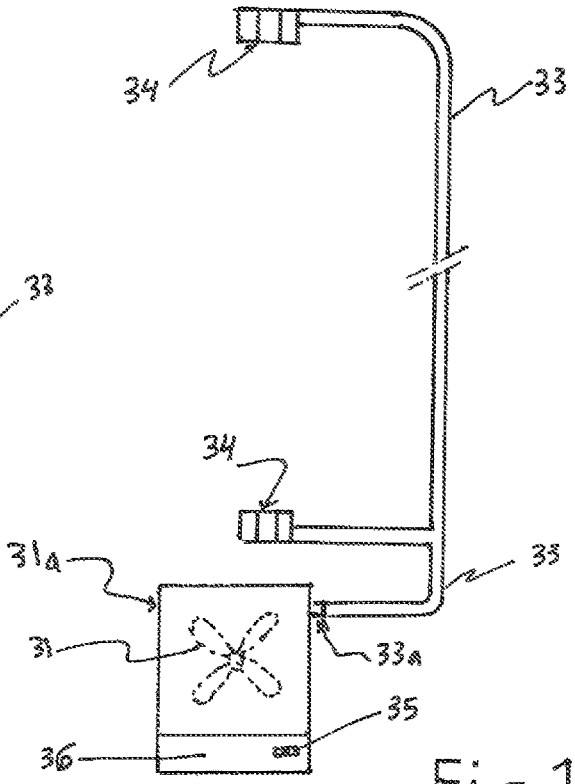

FIG. 10 shows also the exit of a suction tube 33 and its connection collar 33*a* to the exhaust fan box 31*a*. The suction tube 33 extends on the both sides of the face shield 10 and each branch ends by a one suction vent 34 at the top of the forehead and another one below the level of the user's chin. FIG. 11 provides an illustration for the suction vent 34 and its connection with suction tube 33. The suction tube 33 and the correspondents vents 34 generally are made of elastic plastic.

Figure 13:
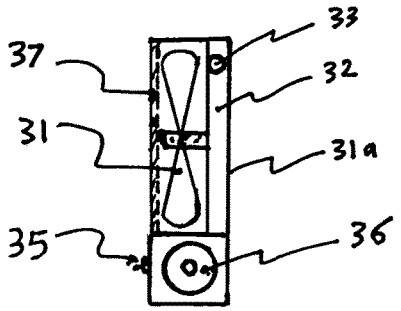
FIGS. 12, 13 and 14 are the front-view illustration of the exhaust fan box, and a vertical and plan cross section views through the exhaust fan box.
Figure 12:
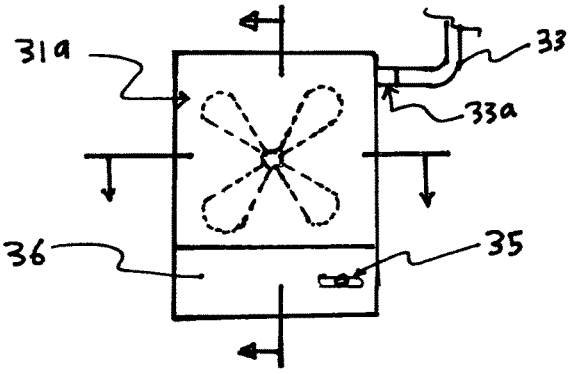
Figure 14:
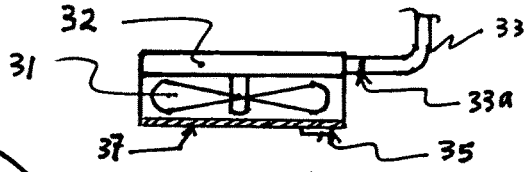

FIGS. 12, 13 and 14 provide details of the exhaust fan box 31*a*. They illustrate in details the components of the exhaust fan box 31*a*. The exhaust fan 31 rests in the front portion of the exhaust fan box 31*a*. The exit face of the exhaust fan box 31*a* which faces to the outlet of the exhaust fan 31, is covered by an exhaust fan outlet filter 37 for filtering exhaust air before getting out to the atmosphere and also protecting air back revers seeping to the system. At the suction side of the exhaust fan box 31*a*, there is a suction room 32 inside the exhaust fan box 31*a* and it locates behind the exhaust fan 31 suction side. The suction room 32 is connected to the suction tube 33 through a suction tube connector 33*a*. Inside the exhaust fan box 31*a* there is a room for the source of power named battery room 36 which has the wire connections to the exhaust fan 31 through a power switch 35.

This construction of the ventilation system element 30, is designed to provide efficient drainage of the exhalation and vapor or humid air through the top and bottom suction vents 34. The suction power of the exhaust fan 31 expels efficiently away the accumulated exhalation and the humid air from the wearer's face and glasses if there is any. By this mean, no vapor accumulation or condensation on the face shield element 20 or on the user's glasses. This arrangement, as described above, provides superior ventilation of a wearer's head over the prior art.

Figure 15:
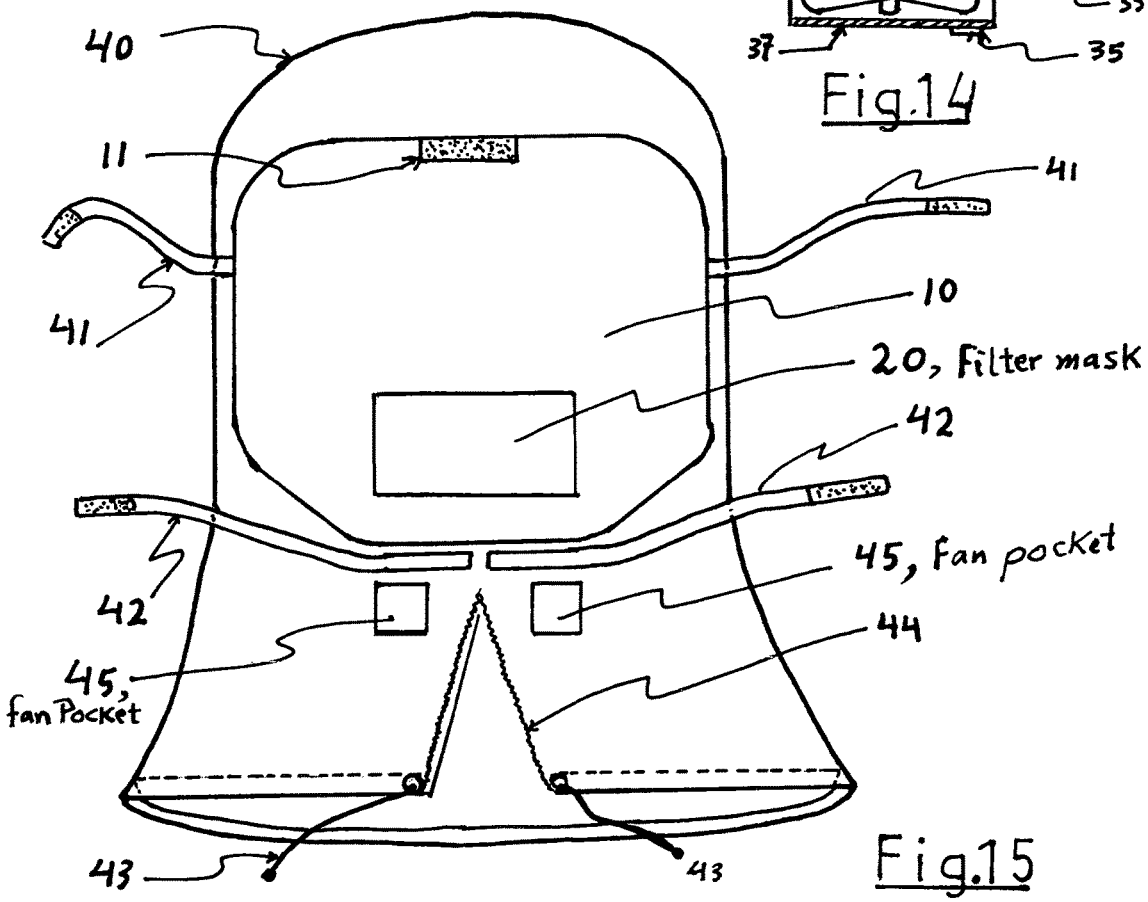
FIG. 15 is a schematic perspective view illustration of the head cover mask element comprising the combination face shield shown above in FIG. 4 as fixed and attached to the head cover mask element of the present disclosure including head and middle band straps and neck band cord string.

FIG. 15 illustrates the components of the head cover mask element 40 which covers the head and neck of the user. The head cover mask 40 is a cylindrical fabric garment adhered tightly with the boundaries of the face shield 10 by a suitable glue material. The head cover mask element 40 comprises three fastening means: the head band strap 41, the middle band strap 42, and the fasten neck band cord string 43. The head band strap 41 is a two pieces flexible fabric strap ends with a distance provided a friction fastener material for fixation such as the preferably material of VELCRO™, which is a well known and readily available friction fastener. The head band strap 41 extends to encircle around the user's head in order to keep the face shield element 10 fold around the wearer's face in a comfort position. The middle band strap 42 is a similar one to the head band strap 41. However, its function is to tight the head cover mask 40 and extends encircle around the neck of the wearer at below the line of the wearer's chin. The third fastener component is the fasten neck band cord string 43, which provides more tightness of the head cover mask 40 around the neck.

The zipper 44 is attached to the head cover mask 40 in order to facilitate the wearer put-on or put-off the full face and head mask 100. It extends from top at a middle central point almost below the user's chin on the head cover mask 40 to the lower end of the head cover mask 40 at the level of the fasten neck band cord string 43. In any event, the level of the lower edge of the head cover mask 40 and with accordance to the described structure, it should not be such as to interfere with the exhalation of air to the atmosphere nor the inhalation of fresh air from the atmosphere.

The head cover mask 40 is also provided by one or two fan pockets 45 to fit in and hold inside it the exhaust fan boxes 31*a*, which they are components of the ventilation system element 30. Those fan pockets 45 has a small tight opening to pass through the suction tube 33. The fan pocket 45 is made from elastic material such as the same material of the head cover mask element 40 and allow flexibility for the user touching the power switch 35 on the exhaust fan box 31*a*.

To fit many different-sized faces with one mask, this head cover mask element 40 can have margin tolerances in its dimensions around the head. This will serve the needs of women for protecting the style of their hair.

Generally, the head cover mask 40 element is manufactured using a fabric or material that is both comfortable when worn and suitable for outdoor use. Examples of suitable materials could include wool, polyester, nylon or other suitable materials. In addition, these materials may include certain other desirable characteristics for outdoor use such as waterproofing and insulation. The head cover mask element 40 can comprise a variety of different colors and/or appearances based on the intended use and gender preferences.

The present disclosure, the full face and head mask 100, may be provided in different sizes (i.e. small, medium, large) for users children, woman and men of different sizes. The full face and head mask 100 as it is described and according to the construction stated above it can be used in cold weathers for protecting user's face from environmental harsh elements.

Although various embodiment of the present invention have been disclosed here for purposes of illustration, it should be understood that a variety of changes, modifications and substitutions may be incorporated without departing from either the spirit or scope of the present invention and within the scope of the appended claims.

What is claimed as being new and desired to be protected by Letter Patent of the United States is as follows:

1. A full face and head mask for protecting a human user's face and head against pathogenesis including viruses or bacteria, dust, or environmental contaminants, comprising:

a face shield;

a multi-layer filter mask rests on said face shield;

a ventilator attached to said face shield, the ventilator comprises a motorized fan, a suction tube, and at least one suction vent; and a head cover mask which extends to cover a user's head and neck, wherein the head cover mask comprises at least one upper strap and at least one lower strap, and the head cover mask is affixed to said face shield, wherein the face shield comprises an opening, wherein the opening is covered by the multi-layer filter mask, the multi-layer filter mask is removably attached to the opening, the head cover mask comprises a neck portion for covering the neck, wherein the neck portion comprises an opening that is configured to surround the neck of the user, a fastener for allowing a size of the opening of the neck portion to expand and constrict, the at least one lower strap, and a pocket for receiving the motorized fan of the ventilator, and wherein the full face and head mask further comprises an internal space for receiving the suction tube and the at least one suction vent.

2. The full face and head mask according to claim 1, wherein the motorized fan comprises a box, wherein a battery room for accommodating a source of power located within the box, and a power switch is located on the box.

3. The full face and head mask according to claim 1, wherein the fastener comprises a zipper and/or a neck band.

4. A full face and head mask for protecting a human user's face and head against pathogenesis including viruses or bacteria, dust or environmental contaminants, comprising: a face shield, a multi-layer filter mask rests on said face shield, a ventilator attached to said face shield, and a head cover mask which extends to cover a user's head and neck and the head cover mask is affixed to said face shield, said face shield is made of a flexible transparent and elastic material and is configured to extend across and cover a user's face from a top level of the user's forehead to a bottom level of the user's chin and at least a portion of the user's cheeks and substantially covers all of the user's eyes, nose and mouth, wherein the face shield comprising:

a) a filter mask window configured as a rectangular opening that extends over the nose and mouth of a wearer, wherein an adhesive window strip is provided on the face shield such that the adhesive window strip surrounds boundaries that formed the filter mask window, wherein the adhesive window strip is for facilitating fixation of said multi-layer filter mask on the face shield;

b) four pin support beds, wherein each of the four pin support beds is configured as a plastic cube, wherein each of the four pin support bed is fixed on each corner of the four corners of said filter mask window of the face shield, wherein each of the four pin support bed comprises a groove for receiving a fixation pin of the multi-layer filter mask;

c) a rubber gasket ring fixed on internal four sides edge boundaries of said filter mask window for protecting a wearer's skin from scratching or hurting during donning or take off said full face and head mask; and d) a sponge material attached on an internal surface of said face shield at a level of a user's forehead and is configured to keep said face shield up right by a distance apart from the user's face and the user's glasses.

5. A full face and head mask for protecting a human user's face and head against pathogenesis including viruses or bacteria, dust or environmental contaminants, comprising: a face shield, a multi-layer filter mask rests on said face shield, a ventilator attached to said face shield, and a head cover mask which extends to cover a user's head and neck and the head cover mask is affixed to said face shield, wherein said multi-layer filter mask is made of a filter material configured to protect the user against different pathogenesis including viruses or bacteria, dust or environmental contaminants, and the multi-layer filter mask is removable and replaceable, wherein the multi-layer filter mask is configured to rest on a filter mask window opening of said face shield, wherein the multi-layer filter mask comprises:

a) two fixation sticks, each of the two fixation sticks are positioned on each edge side of said multi-layer filter mask, wherein a bent handle is provided at a middle of each fixation stick of the two fixation sticks for protecting a filter portion of said multi-layer filter mask from the user direct touching the filter material, wherein each of the two fixation sticks comprises two ends, wherein each end of the two ends form a fixation pin, and the fixation pin is configured to rest on a groove of a pin support bed of four pin support beds that are fixed to four corners of said filter mask window opening of said face shield;

and b) adhesive mask strips are affixed around four sides of said multi-layer filter mask for fixation of the multi-layer filter mask on said filter mask window opening.

* * * * *